US011484063B2

(12) United States Patent
Liu

(10) Patent No.: US 11,484,063 B2
(45) Date of Patent: Nov. 1, 2022

(54) ELECTRONIC CIGARETTE HAVING AN ATOMIZATION ASSEMBLY DISPOSED ON A BATTERY ASSEMBLY

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 293 days.

(21) Appl. No.: 16/870,883

(22) Filed: May 8, 2020

(65) Prior Publication Data

US 2021/0093002 A1 Apr. 1, 2021

(30) Foreign Application Priority Data

Sep. 26, 2019 (CN) ..... 201910918812.7
Sep. 26, 2019 (CN) ..... 201921624045.0

(51) Int. Cl.
*A24F 40/42* (2020.01)
*A24F 40/10* (2020.01)
*A24F 40/50* (2020.01)

(52) U.S. Cl.
CPC ..... *A24F 40/42* (2020.01); *A24F 40/10* (2020.01); *A24F 40/50* (2020.01)

(58) Field of Classification Search
CPC ..... A24F 40/10; A24F 40/40; A24F 40/42; A24F 40/50
See application file for complete search history.

(56) References Cited

U.S. PATENT DOCUMENTS

2020/0315264 A1* 10/2020 Liu ..... A24F 40/40
2021/0030980 A1* 2/2021 Liu ..... A24F 40/40
2021/0045444 A1* 2/2021 Liu ..... A24F 40/50
2021/0186106 A1* 6/2021 Liu ..... A24F 40/40

* cited by examiner

*Primary Examiner* — Hae Moon Hyeon
(74) *Attorney, Agent, or Firm* — Matthias Scholl P.C.; Matthias Scholl

(57) ABSTRACT

An electronic cigarette including an atomization assembly and a battery assembly. The atomization assembly is disposed on the battery assembly. The atomization assembly includes an e-liquid tank; a seal plug; a seal collar; a base; a plurality of first magnets; a metal casing; an atomizer; a seal cover; an O-ring; a cylinder; a spring; a first seal ring; and a funnel. The battery assembly includes a second seal ring; an air column; an electrode pair; a plurality of second magnets; a seal sleeve; a pneumatic switch; a press plate; a battery; a control panel; a support; a housing; and a button. The seal collar is sheathed on the base; the base includes a hollow rod and the seal plug is disposed on one end of the hollow rod; the e-liquid tank is disposed on the base; the base includes a plurality of bottom recesses.

2 Claims, 5 Drawing Sheets

ELECTRONIC CIGARETTE HAVING AN ATOMIZATION ASSEMBLY DISPOSED ON A BATTERY ASSEMBLY

CROSS-REFERENCE TO RELATED APPLICATIONS

Pursuant to 35 U.S.C. § 119 and the Paris Convention Treaty, this application claims foreign priority to Chinese Patent Application No. 201910918812.7 filed Sep. 26, 2019 and to Chinese Patent Application No. 201921624045.0 filed Sep. 26, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an electronic cigarette.

Electronic cigarettes atomize nicotine-containing e-liquid.

The atomizer of conventional electronic cigarettes is fixedly disposed.

SUMMARY

The disclosure provides an electronic cigarette comprising an atomization assembly and a battery assembly. The atomization assembly is disposed on the battery assembly. The atomization assembly comprises an e-liquid tank; a seal plug; a seal collar; a base; a plurality of first magnets; a metal casing; an atomizer; a seal cover; an O-ring; a cylinder; a spring; a first seal ring; a funnel. The battery assembly comprises a second seal ring; an air column; an electrode pair; a plurality of second magnets; a seal sleeve; a pneumatic switch; a press plate; a battery; a control panel; a support; a housing; and a button.

The seal collar is sheathed on the base; the base comprises a hollow rod and the seal plug is disposed on one end of the hollow rod; the e-liquid tank is disposed on the base; the base comprises a plurality of bottom recesses, and the plurality of first magnets is disposed in the plurality of bottom recesses, respectively; the metal casing encompasses the base; the metal casing and the base each comprise a through hole, and the atomizer passes through the metal casing and the base via the through hole and extends into the e-liquid tank; the O-ring is sheathed on the seal cover; the spring and the first seal ring sequentially sleeve the funnel in that order, and the seal cover is disposed on the funnel; the funnel is disposed in the cylinder; and the cylinder is directly connected to the base.

The second seal ring is sheathed on the air column; the air column, the electrode pair, and the plurality of second magnets are disposed on the support; the seal sleeve is sheathed on the pneumatic switch; the pneumatic switch is fixed on the control panel; positive and negative electrodes of the control panel are connected to positive and negative electrodes of the battery, respectively; the control panel and the battery are fixed on the support via the press plate; the support is disposed in the housing; the housing comprises a recess and the button is disposed in the recess.

The disclosure also provides an atomization assembly, comprising an e-liquid tank; a seal plug; a seal collar; a base; a plurality of first magnets; a metal casing; an atomizer; a seal cover; an O-ring; a cylinder; a spring; a first seal ring; a funnel. The seal collar is sheathed on the base; the base comprises a hollow rod and the seal plug is disposed on one end of the hollow rod; the e-liquid tank is disposed on the base; the base comprises a plurality of bottom recesses, and the plurality of first magnets is disposed in the plurality of bottom recesses, respectively; the metal casing encompasses the base; the metal casing and the base each comprise a through hole, and the atomizer passes through the metal casing and the base via the through hole and extends into the e-liquid tank; the O-ring is sheathed on the seal cover; the spring and the first seal ring sequentially sleeve the funnel in that order, and the seal cover is disposed on the funnel; the funnel is disposed in the cylinder; and the cylinder is directly connected to the base.

DETAILED DESCRIPTION

To further illustrate, embodiments detailing an electronic cigarette are described below. It should be noted that the following embodiments are intended to describe and not to limit the disclosure.

Figure 1:
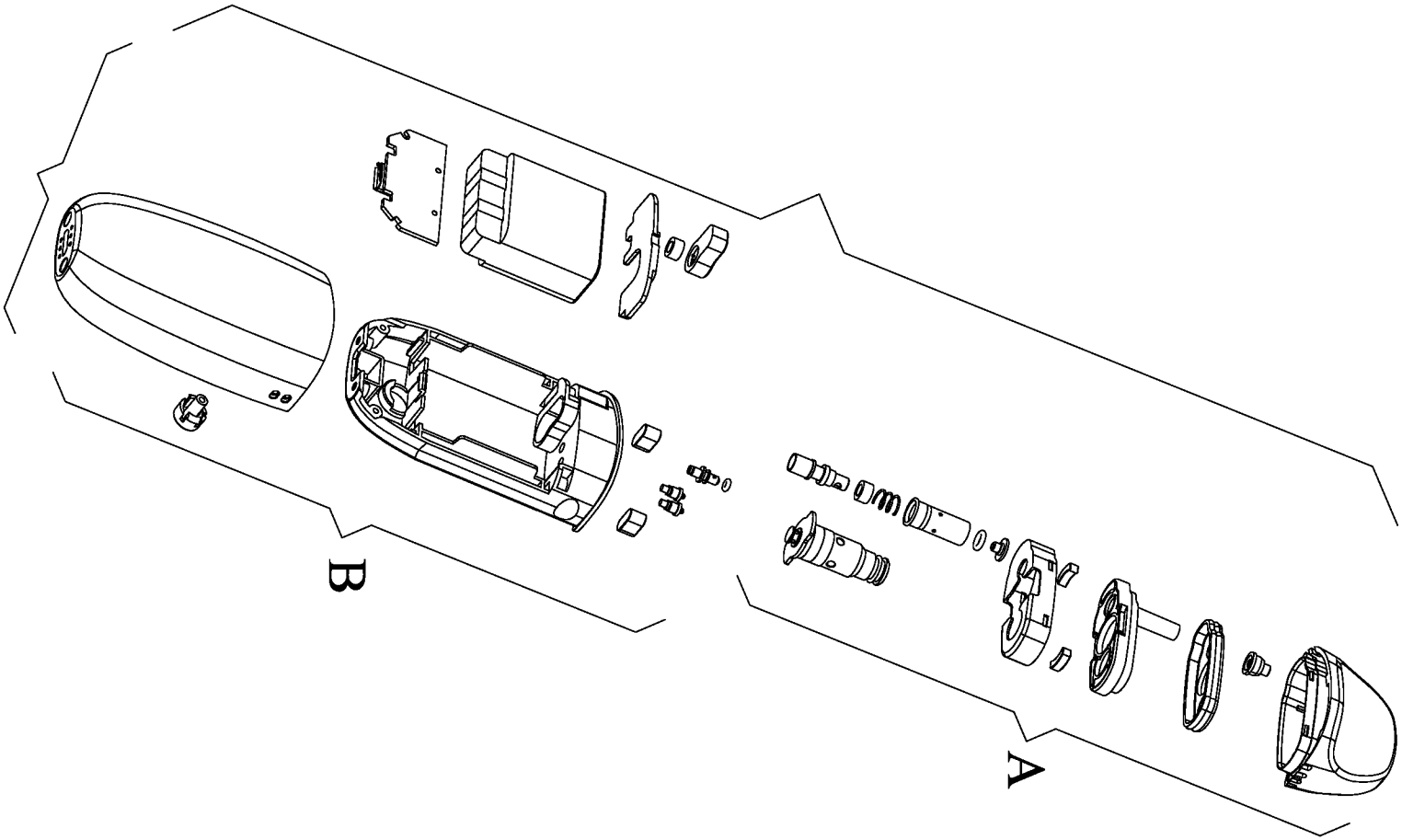
FIG. 1 is an exploded view of an electronic cigarette according to one embodiment of the disclosure.
Figure 2:
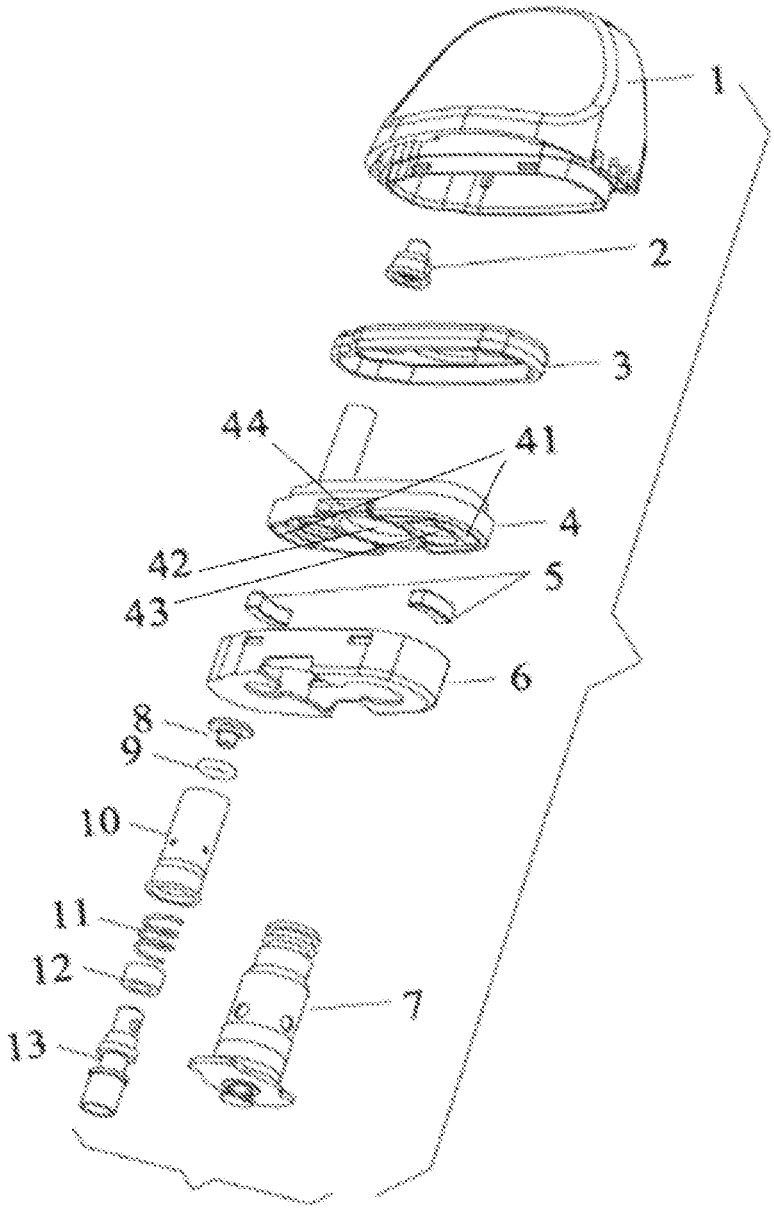
FIG. 2 is an exploded view of an atomization assembly of an electronic cigarette according to one embodiment of the disclosure.
Figure 3:
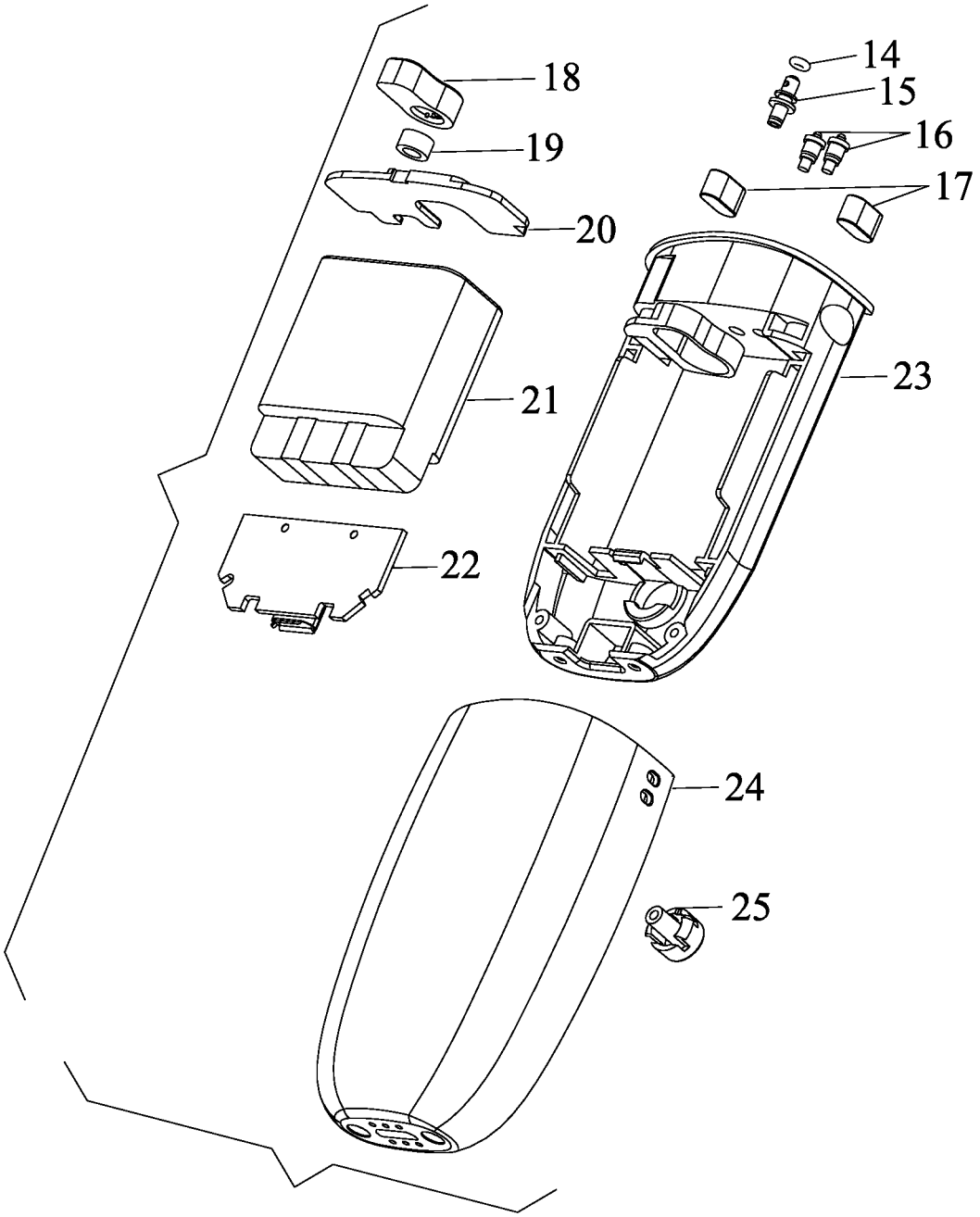
FIG. 3 is an exploded view of a battery assembly of an electronic cigarette according to one embodiment of the disclosure.
Figure 4:
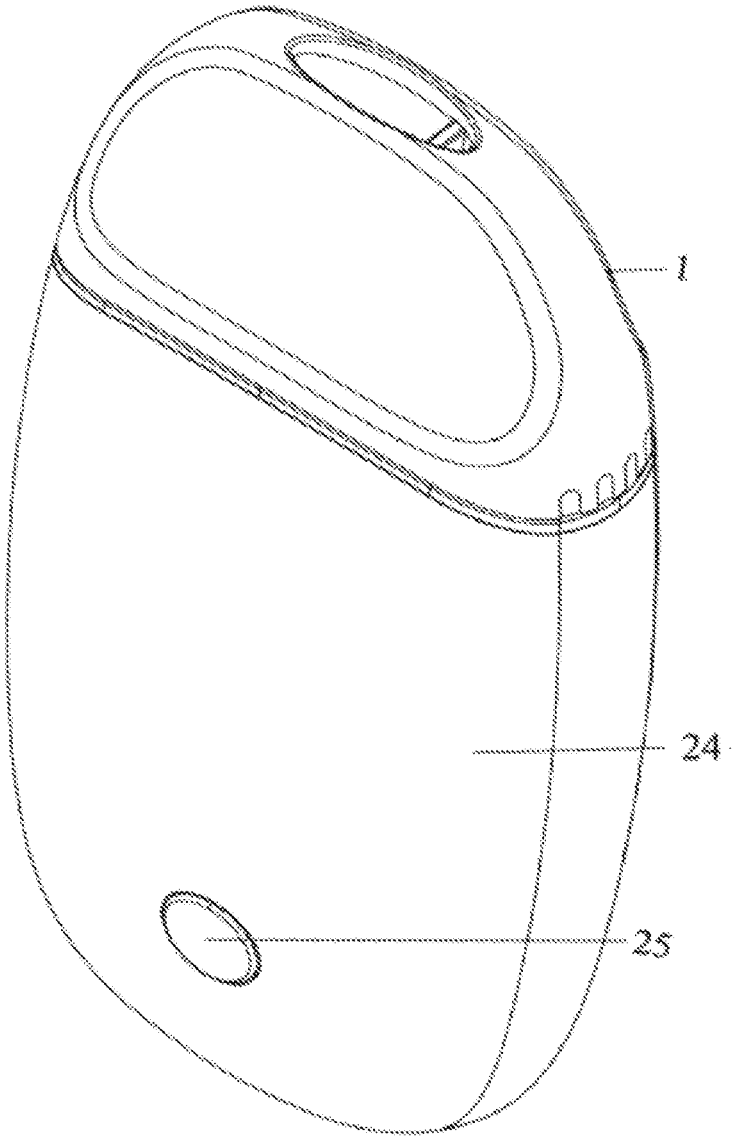
FIG. 4 is a front view of an electronic cigarette according to one embodiment of the disclosure.
Figure 5:
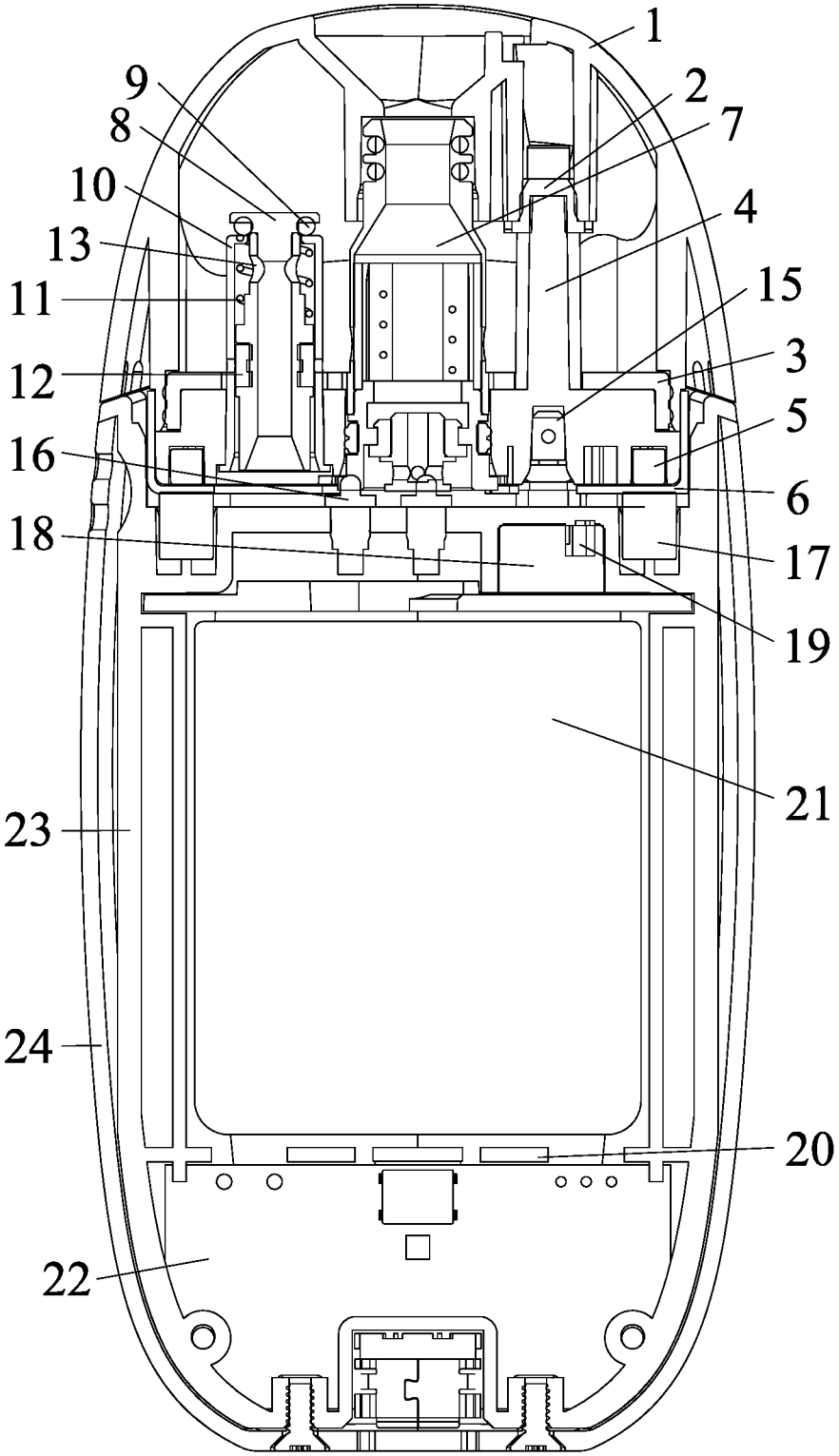
FIG. 5 is a sectional view of an electronic cigarette according to one embodiment of the disclosure.

As shown in FIGS. 1-5, an electronic cigarette comprises an atomization assembly A and a battery assembly B. The atomization assembly A is disposed on the battery assembly B.

The atomization assembly A comprises an e-liquid tank 1; a seal plug 2; a seal collar 3; a base 4; a plurality of first magnets 5; a metal casing 6; an atomizer 7; a seal cover 8; an O-ring 9; a cylinder 10; a spring 11; a first seal ring 12; a funnel 13.

The seal collar 3 is sheathed on the base 4; the base 4 comprises a hollow rod and the seal plug 2 is disposed on one end of the hollow rod; the e-liquid tank 1 is disposed on the base 4; the base 4 comprises a plurality of bottom recesses 41, and the plurality of first magnets 5 is disposed in the plurality of bottom recesses 41, respectively; the metal casing 6 encompasses the base 4; the metal casing 6 comprises a through hole and the base 4 comprises a through hole, hole 42, and the atomizer 7 passes through the metal casing 6 and the base 4 via the through hole of the metal casing 6 and the through hole 42 and extends into the e-liquid tank 1; the O-ring 9 is sheathed on the seal cover 8; the spring 11 and the first seal ring 12 sequentially sleeve the funnel 13 in that order, and the seal cover 8 is disposed on the funnel 13; the funnel 13 is disposed in the cylinder 10; and the cylinder 10 is directly connected to the base 4.

The atomizer 7 is disposed in the through hole of the metal casing 6 and the through hole 42 of the base 4. Thus, when the atomizer 7 breaks down, it is easy to pull out for repair or replacement. Press the funnel 13, the e-liquid inlet of the atomizer 7 is opened, so that the e-liquid is conveniently injected into the atomizer 7. After the injection is finished, loosen the funnel 13, the e-liquid inlet of the atomizer 7 is automatically closed, thus preventing the leakage of the e-liquid.

The battery assembly B comprises: a second seal ring 14; an air column 15; an electrode pair 16; a plurality of second magnets 17; a seal sleeve 18; a pneumatic switch 19; a press plate 20; a battery 21; a control panel 22; a support 23; a housing 24; and a button 25.

The second seal ring 14 is sheathed on the air column 15; the air column 15, the electrode pair 16, and the plurality of second magnets 17 are disposed on the support 23; the seal sleeve 18 is sheathed on the pneumatic switch 19; the pneumatic switch 19 is fixed on the control panel 22; positive and negative electrodes of the control panel 22 are connected to positive and negative electrodes of the battery 21, respectively; the control panel 22 and the battery 21 are fixed on the support 23 via the press plate 20; the support 23 is disposed in the housing 24; the housing 24 comprises a recess and the button 25 is disposed in the recess.

The atomization assembly A is connected to the battery assembly B through the attraction of the plurality of first magnets 5 and the plurality of second magnets 17. The base 4 comprises a first air inlet 43 receiving the air column 15 and a second air inlet 44 disposed on the side wall of the base 4. During the inhaling, the pneumatic switch 19 is triggered to work. The air column 15 blocks the air inlet 43 of the base base 4 and the air enters the atomizer 7 via the second air inlet 44 on the side wall, thus preventing the condensed e-liquid from flowing into the battery assembly B.

It will be obvious to those skilled in the art that changes and modifications may be made, and therefore, the aim in the appended claims is to cover all such changes and modifications.

What is claimed is:

1. A device, comprising: an atomization assembly and a battery assembly; the atomization assembly being disposed on the battery assembly;

the atomization assembly comprising:

1) an e-liquid tank;
2) a seal plug;
3) a seal collar;
4) a base;
5) a plurality of first magnets;
6) a metal casing;
7) an atomizer;
8) a seal cover;
9) an O-ring;
10) a cylinder;
11) a spring;
12) a first seal ring; and
13) a funnel;

the battery assembly comprising:

14) a second seal ring;
15) an air column;
16) an electrode pair;
17) a plurality of second magnets;
18) a seal sleeve;
19) a pneumatic switch;
20) a press plate;
21) a battery;
22) a control panel;
23) a support;
24) a housing; and
25) a button;

wherein:

the seal collar is sheathed on the base; the base comprises a hollow rod and the seal plug is disposed on one end of the hollow rod; the e-liquid tank is disposed on the base; the base comprises a plurality of bottom recesses, and the plurality of first magnets is disposed in the plurality of bottom recesses, respectively; the metal casing encompasses the base; the metal casing and the base each comprise a through hole, and the atomizer passes through the metal casing and the base via the through hole and extends into the e-liquid tank; the O-ring is sheathed on the seal cover; the spring and the first seal ring sequentially sleeve the funnel in that order, and the seal cover is disposed on the funnel; the funnel is disposed in the cylinder; and the cylinder is directly connected to the base; and the second seal ring is sheathed on the air column; the air column, the electrode pair, and the plurality of second magnets are disposed on the support; the seal sleeve is sheathed on the pneumatic switch; the pneumatic switch is fixed on the control panel; positive and negative electrodes of the control panel are connected to positive and negative electrodes of the battery, respectively; the control panel and the battery are fixed on the support via the press plate; the support is disposed in the housing; the housing comprises a recess and the button is disposed in the recess.

2. An atomization assembly, comprising:

1) an e-liquid tank;
2) a seal plug;
3) a seal collar;
4) a base;
5) a plurality of first magnets;
6) a metal casing;
7) an atomizer;
8) a seal cover;
9) an O-ring;
10) a cylinder;
11) a spring;
12) a first seal ring; and
13) a funnel;

wherein:

the seal collar is sheathed on the base; the base comprises a hollow rod and the seal plug is disposed on one end of the hollow rod; the e-liquid tank is disposed on the base; the base comprises a plurality of bottom recesses, and the plurality of first magnets is disposed in the plurality of bottom recesses, respectively; the metal casing encompasses the base; the metal casing and the base each comprise a through hole, and the atomizer passes through the metal casing and the base via the through hole and extends into the e-liquid tank; the O-ring is sheathed on the seal cover; the spring and the first seal ring sequentially sleeve the funnel in that order, and the seal cover is disposed on the funnel; the funnel is disposed in the cylinder; and the cylinder is directly connected to the base.

* * * * *